United States Patent [19]

Satoh

[11] 4,141,435

[45] Feb. 27, 1979

[54] ELEVATOR CONTROL SYSTEM

[75] Inventor: Tsuyoshi Satoh, Inazawa, Japan

[73] Assignee: Mitsubishi Denki Kabushiki Kaisha, Tokyo, Japan

[21] Appl. No.: 844,920

[22] Filed: Oct. 25, 1977

[30] Foreign Application Priority Data

Oct. 28, 1976 [JP] Japan ..... 51-129707

[51] Int. Cl.[2] ..... B66B 5/00

[52] U.S. Cl. ..... 187/29 R

[58] Field of Search ..... 187/29

[56] References Cited

U.S. PATENT DOCUMENTS

| | | | |
|---|---|---|---|
| 2,969,128 | 1/1961 | Jones et al. | 187/29 |
| 3,414,088 | 12/1968 | Bruns et al. | 187/29 |
| 3,592,296 | 7/1971 | Senn | 187/29 |
| 3,773,146 | 11/1973 | Dixon, Jr. et al. | 187/29 |

*Primary Examiner*—Robert K. Schaefer
*Assistant Examiner*—W. E. Duncanson, Jr.
*Attorney, Agent, or Firm*—Oblon, Fisher, Spivak, McClelland & Maier

[57] ABSTRACT

An elevator control system using an electric type floor selector is disclosed including a unit provided at at least one of the specific floors in the hoistway and for indicating the specific floor, units provided at the other floors than the specific floors and for indicating merely the floor, a detector provided at a car in which presence of both the units is detected and when the detector levels with the respective units the detector generates a signal corresponding to it, a floor indicator for indicating the floor at which the car actually stops by using the detected signal, and a stop permissible floor indicator for indicating the electrically calculated stop floor when the car stops. Comparison is made of the output of the floor indicator with the output of the stop permissible floor indicator. In the comparison, when these outputs are different, the car is moved to the specific floor. When the car stops at the specific floor, the floor indicator and the stop permissible floor indicator are set to the specific floor.

2 Claims, 5 Drawing Figures

ELEVATOR CONTROL SYSTEM

BACKGROUND OF THE INVENTION

The present invention relates to an elevator control system.

A recent technical trend of the elevator control system shifts from the control using mechanical components to that using electric and electronic components due to various factors; development of electronics, lengthened travelling length of elevator cars, speed-up of elevator travelling, high-level demands of passengers, and the like.

In elevator control systems, a basic operation is that, when a call is registered, a car moves in response to the registered call to satisfy the demand of the call. In order to improve the service, however, consideration is taken so that, even after the car starts to move, it answers to the call issued from the floor at which it is permitted to stop for service. For this, the elevator control must calculate the position or floor at which the travelling car may stop in relation to its travelling speed, by some method. In conventional control systems with mechanical type floor selectors, the car stop is decided by using a selector (to indicate the car position) moving synchronized to travel of the car and an advance selector (to indicate the position permitting the car to stop thereat) moving proportional to travel of the car. However, the mechanical type control system can hardly exert its proper control to high-speed and high-rise elevator systems, due to the limitation of finishing accuracy, diminishing scale, and the like. This has contrived the electric type floor selector.

FIG. 1 shows an elevator control system employing the electric type floor selector. In the figure, (1) is an elevator car which is supported by a hoisting rope (4) extending up over a traction sheave (3) provided around the shaft of a drive motor (2). (5) is a counterweight connected to the other end of the rope (4). (6) is a looped speed governor rope connected at one end to the top of the car (1) while at the other end to the bottom of the car (1). The speed governor rope is wound around a governor sheave (7) disposed over the top of the car (1) running in the hoistway and a pulley (8) disposed at the bottom of the hoistway. (9) is a pulse generator for pulses corresponding to the amount of the travel of the car (1) coupled with the governor sheave (7), and generates one pulse each unitary movement (for example, 5 mm, 10 mm) of the cage (1). (10) designates respective floors and 1st to nth floors represented by (1F) to (nF). (11) designates a device indicating the levelling zone. Each floor is provided with one identical device of the levelling zone indication. A detecting device (12) provided on the car (1) permits one to know that the car (1) enters the levelling zone. (13) designates an electric type floor selector. (13*a*) is a car position arithmatic unit which counts the number of pulses fed from the pulse generator (9) when the car (1) goes up, with a reference floor of the floor (1F). Through the counting operation, it indicates the position in the hoistway where the car (1) passes with respect to the reference point (1F). (13*b*) denotes a floor position memory for permanently memorize the positions of respective floors in terms of the distance from the reference point. (1F). By addressing one of the floors (1F) to (nF), it produces the distance from the reference point corresponding to the floor addressed.

(13*c*) is a stop permissible position arithmatic device in which the stop permissible position of the running car (1) is calculated on the basis of the position information fed from the pulse generator (9), the speed information (not shown) of the car (1) and like. (13*d*) is a comparator in which the output of the floor position memory (13*b*) and the output of the stop permissible position arithmatic unit (13*c*) are compared to produce a large or small magnitude output of a result of the comparison in accordance with the travelling direction of the car (1). (13*e*) is a stop permissible floor indicator which increases or decreases by one each time the output of the comparator (13*d*) is given thereto to produce an output indicating the stop permissible floor. (13*f*) represents a stop decision arithmatic unit which receives at the input a call corresponding to the stop permissible floor fed from the stop permissible floor indicator (13*e*) and produces a stop decision signal when there is a responsible call. (13*g*) represents a remaining distance arithmatic unit in which, when the stop of the car (1) is decided, a difference is calculated between the distance of the stop decided floor from the reference point and the distance of the car (1) positioning at present from the reference point to produce the remaining distance by which the car (1) must travel till it stops which in turn is applied to a speed pattern generator 8 (not shown).

Assume now that the car (1) stops at the floor (1F) (used as the reference floor), and at this time the car position (13*a*) is zero and the stop permissible floor indicator (13*e*) indicates (1F). Under this condition, the car (1) starts to move in response to generation of a call from an upper floor. With movement of the car (1), the speed governor sheave (7) starts to rotate and the pulse generator (9) generates the number of pulses corresponding to the amount of the car (1) movement. The pulses are fed to the car position arithmatic unit (13*a*) and the stop permissible position arithmatic unit (13*c*) where necessary calculation are performed. The stop permissible floor indicator (13*e*) indicates (2F) to which 1 is automatically added by an up-direction start signal (not shown) of the car (1). The floor position memory (13*b*) outputs the distance from the reference point to the floor (2F), with addressing (2F). The comparator (13*d*) compares the output of the floor position memory (13*b*) with (2F) addressing with the output of the stop permissible position arithmatic unit (13*c*). When the output of the stop permissible position arithmatic unit (13*c*) is larger, the comparator (13*d*) produces a large signal which adds 1 to the contents of the stop permissible floor indicator (13*e*). With the addition of 1, the indicator produces (3F) while the floor position memory (13*b*) produces an output with addressing of (3F). In this manner, the output of the stop permissible floor indicator (13*e*) changes. On the other hand, the stop decision arithmatic unit (13*f*) constantly seeks a call to be responsed to the stop floor indicated by the stop permissible indicator (13*e*). If a call is now generated from the floor (4F), the stop decision arithmatic unit (13*f*) issues a stop decision signal to be directed to the stop permissible position arithmatic unit (13*c*) thereby to stop the operation of it. After this, the comparator (13*d*) does not operate and the output of the stop permissible floor indicator (13*e*) indicates the floor at which the car (1) will stop. Further, the stop decision signal is given to the remaining distance arithmetic unit (13*g*) which in turn produces the difference between the position of the car (1) in the hoistway and the position by the floor position memory (13*b*), as the remaining distance to be travelled by the car (1).

When the levelling zone indicating device (11) and the detecting device (12) cooperate to detect that the car enters the levelling zone, a levelling device (not shown) separately provided generally causes the car (1) to be levelled with the floor level to stop its travelling. Upon the stop of the car (1), the output of the floor position memory (13*b*) with the stop floor address of the output of the stop permissible floor indicator (13*e*) is applied to the car position arithmetic unit (13*a*) and the stop permissible position arithmetic unit (13*c*) to set up the initial condition of the car position arithmetic unit (13*a*) and the stop permissible position arithmetic unit (13*c*). In response to a new call, calculation is performed on the basis of the initial condition and the stop is repeated in response to the call.

No problem arises as far as respective apparatuses and units operate correctly; however, when slip takes place, for example, between the speed governor rope (6) and the speed governor sheave (7) and the amount of the slippage exceeds one floor, the floor at which the car actually stops is not coincident with the stop floor indicated by the stop permissible floor indicator (13*e*), resulting in trouble of elevator service. One of the countermeasures for this is that, as shown in FIG. 2, floor identifying units (14-1F) to (14-nF) each for identifying the corresponding floor are installed at the floors, respectively, and a stop floor identifying indicator (13*h*) receiving as its input the output of a floor name detecting unit (15) attached to the car (1) and the stop permissible indicator (13*e*) are corrected each time the car (1) stops.

In this attempt, each floor needs the floor identifying units (14-1F) to (14-nF) for indicating the name of the corresponding floor. Accordingly, when the number of the floors is large, manufacturing of individual floor identifying units and fitting thereof cost much labor and the floor name detecting unit (15) is complex in construction, thus being disadvantageous from economical view point.

SUMMARY OF THE INVENTION

Accordingly, the present invention provides a means to solve the above-mentioned disadvantages. More specifically, an object of the present invention is to provide an elevator control system using an electric type floor selector with a relatively simple construction in which, when an erronous operation occurs, it may be quickly corrected.

According to one aspect of the present invention, there is provided an elevator control system using an electric type floor selector including a unit provided at at least one of the specific floors in the hoistway and for indicating the specific floor, units provided at the other floors than the specific floors and for indicating merely the floor, a detector provided at a car in which presence of both units is detected and when the detector levels with the respective units the detector generates a signal corresponding to it, a floor indicator for indicating the floor at which the car actually stops by using the detected signal, and a stop permissible floor indicator for indicating the electrically calculated stop floor when the car stops. With such an arrangement, comparison is made of the output of the floor indicator with the output of the stop permissible floor indicator. In the comparison, when these outputs are different, the car is moved to the specific floor. When the car stops at the specific floor, the floor indicator and the stop permissible floor indicator are set to the specific floor.

According to another aspect of the present invention, there is provided an elevator control system using an electric type floor selector in which, in the just-mentioned arrangement, a plurality of specific floors are used. Calculation is made of the distances between the floor indicated by the stop permissible indicator or the floor indicated by the floor indicator and the specific floors. The car is moved toward the specific floor with the shortest distance.

Other objects and features of the present invention will be apparent from the following description taken in connection with the accompanying drawings, in which:

BRIEF DESCRIPTION OF THE DRAWINGS

In the drawings, like reference symbols are used to indicate like or equivalent portions.

DESCRIPTION OF THE PREFERRED EMBODIMENTS

Figure 3:
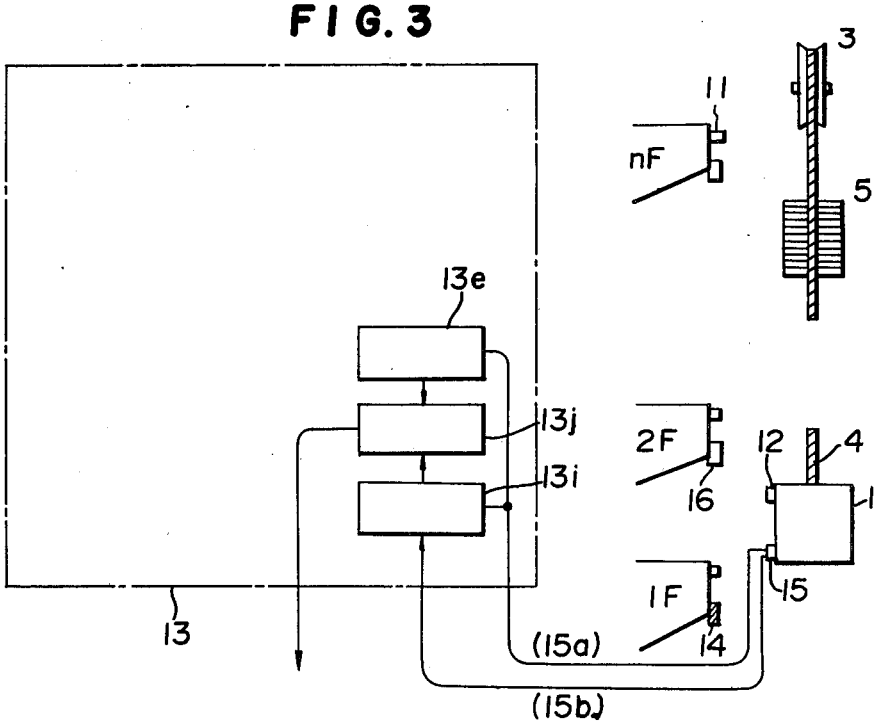
FIG. 3 shows, by way of block and schematic diagram, an elevator control system according to the present invention.

Referring now to FIG. 3, there is shown an embodiment of the present invention.

In the figure, there is provided a unit (14) denoting a specific floor of (1F), with the floor (1F) as the specific floor. The floors other than the (1F) are provided with only the floor denoting units (16), respectively. The car (1) is provided with a detecting unit (15) which may detect the presence of the specific floor denoting unit (14) and the floor denoting units (16). and, when the unit (14) confronts the unit (16), produces signals indicating the confrontation onto signal lines (15*a*) and (15*b*). In more particular, a signal indicating the confrontation of the detecting unit (15) with the specific floor denoting unit (14) appears on the signal line (15*a*). A signal indicating the confrontation of the detecting unit (15) with the floor denoting unit (16) appears on the signal line (15*b*). These signals on the lines are fed to the electric type floor selector (13). (13*i*) is representative of a floor indicator indicating the floor at which the car (1) is positioned. The floor indicator is set to the specific floor by the signal on the signal line (15*a*) and then increases or decreases the floor by one each time the signal appears on the signal line (15*b*) in accordance with the moving direction of the car (1). In this manner, it indicates the floor of the car (1) positioning. When the car (1) stops, a comparator (13*j*) compares the output signal (indicating the floor at which the car (1) is positioned) of the floor indicator (13*i*) with the output (indicating the floor at which the car (1) supposedly stops when it has stopped of the stop permissible floor indicator (13*e*) as a result of calculation. When these outputs are different in the comparing operation, the comparator provides a signal for moving the car (1) toward the specific floor (1F in the figure) to a control unit (not shown) so that it causes the car (1) to travel toward the specific floor. The travelling of the car is stopped by the signal from the specific floor and at the same time the floor indicator (13*i*) and the stop permissible floor indicator (13*e*) are set at the specific floor. Thus, if some cause forces the stop permissible floor indicator (13*e*) or the floor indicator (13*i*) to go wrong, the car (1) is moved to the specific floor to permit that trouble to be remedied thereat.

In the description thus far made, the floor denoting units (16) was used for ease of explanation. However, if the levelling zone denoting unit (11) is used, the floor denoting unit (16) may be omitted. Further, if the detected signal obtained from the levelling zone detecting unit (12) in place of the detecting unit (15) is used as the floor signal, it is possible to use only the specific floor for the object to be detected by the detecting unit (15).

In the above explanation, the first floor was used for the specific floor. However, if a plurality of floors for it are employed with the lengthening of the hoistway, the time taken for the car to reach the specific floor may be shortened. In this case, an arrangement may be possible in which the distances between the floors of the specific floor and the floor indicated by the floor indicator (13*i*) or the stop permissible indicator (13*e*) are calculated and the car is moved to the specific floor which is positioned shortest to the car on the basis of the result of the calculation.

Figure 4:
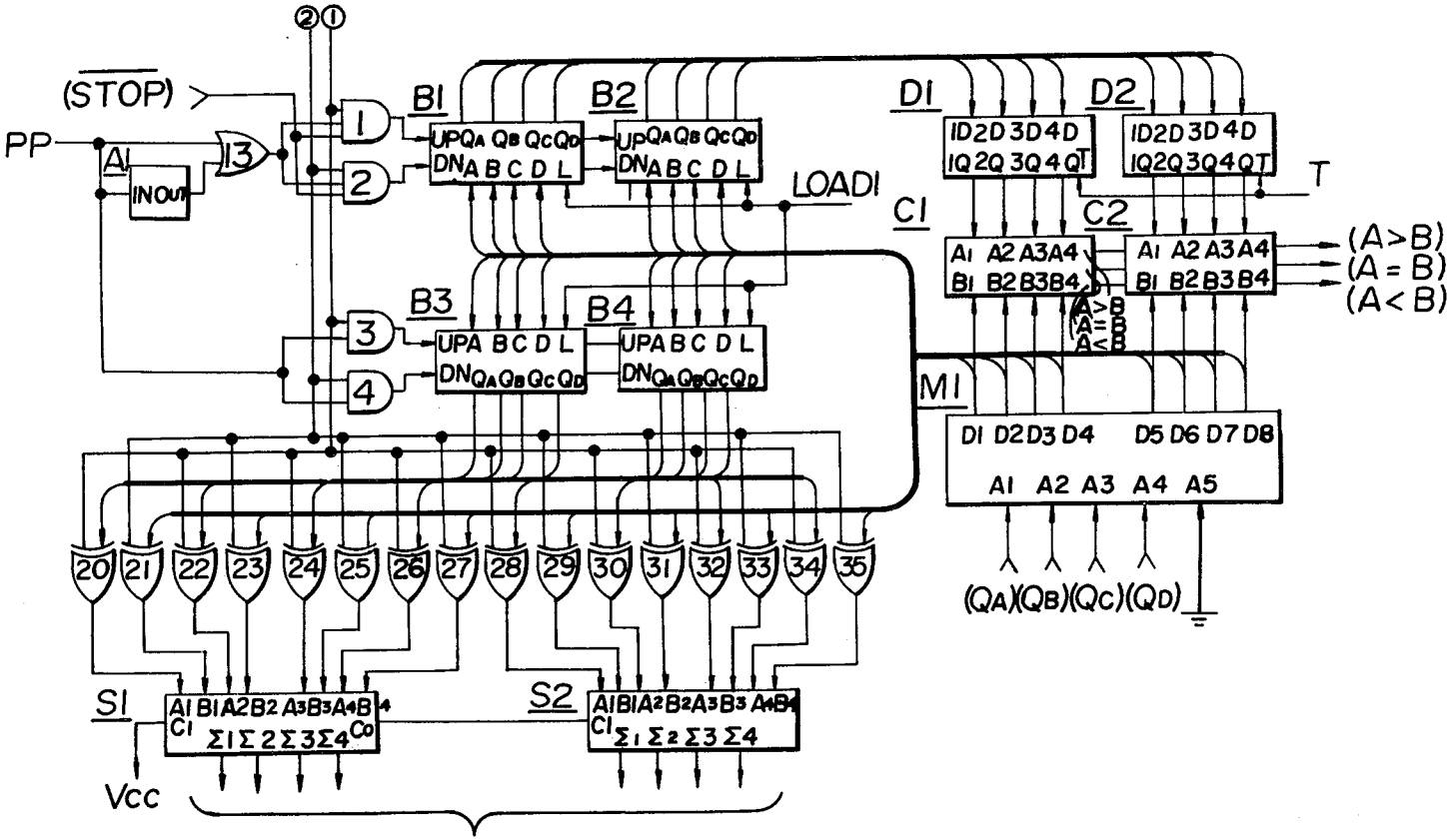
FIGS. 4(*a*) and (*b*) cooperate to form a detailed circuit diagram of FIGS. 1 and 3.
Figure 4:
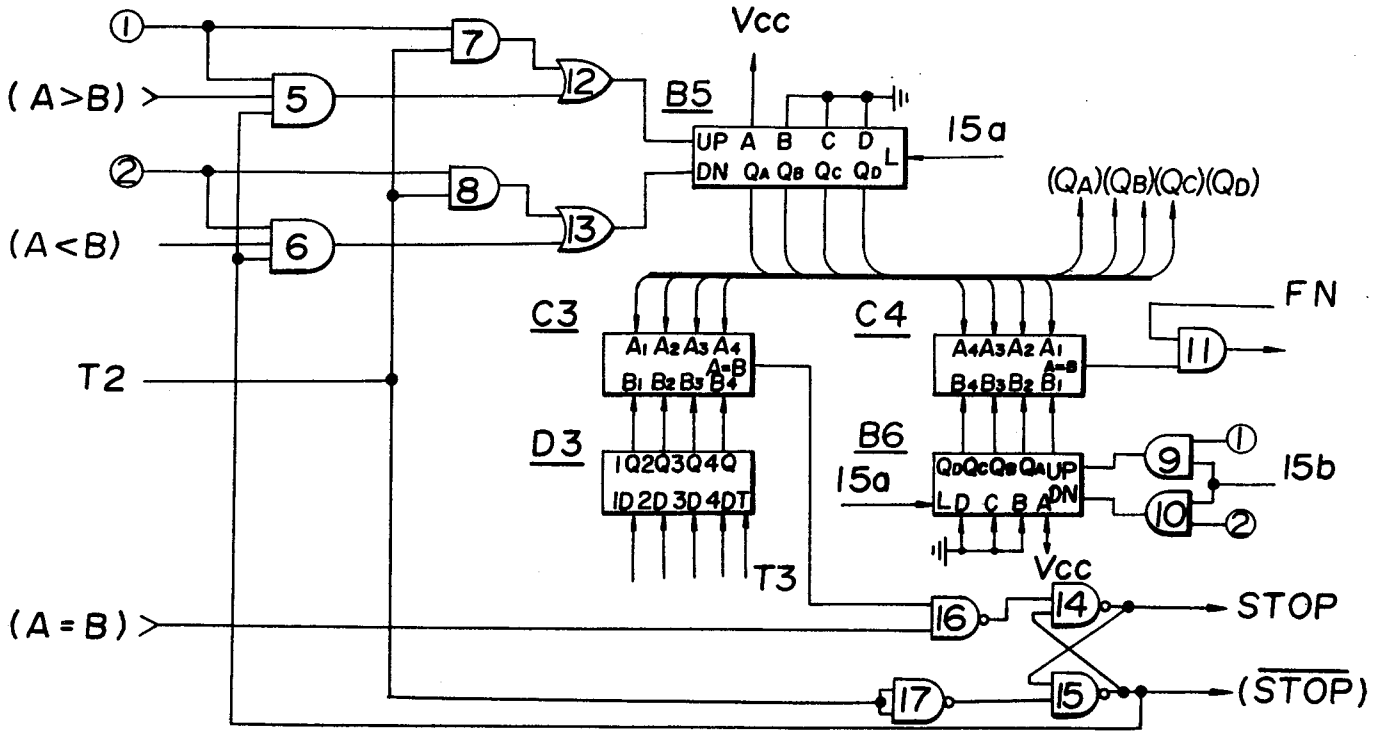

For a better understanding of the present invention, a further detailed description will be given with reference to FIGS. 4(*a*) and (*b*) illustrating the circuit diagram of the electric type floor selector (13) shown in FIGS. 1 and 3. In FIGS. 4(*a*) and (*b*), the signals travelling between the figures (*a*) and (*b*) are put in parenthesis. For example, (A>B) in FIG. 4(*a*) indicates the signal going from (*a*) to (*b*) or fed from (*b*) to (*a*), the direction of the signal travelling depending on the arrow of the signal. Other signals are those fed to respective related units (not shown) or fed from them. In the figure, the functional components are designated by blocks with symbols (e.g. B4) on the left hand shoulders, respectively. And the gate circuits and related ones are indicated by numerals in the functional blocks.

In FIGS. 4(*a*) and (*b*), A1 designates a monostable multivibrator which produces a pulse with a fixed pulse width at the fall time of an input pulse and may use, for example, SN74123 manufactured by TEXAS INSTRUMENT Co. (abbreviated as TI). B1, B2, B3, B4, B5, and B6 are synchronous UP/DOWN presetable 4-bit binary counters and may be constructed by SN74193 by TI, for example, C1 to C4 are 4-bit magnitude comparators each of which has two groups of input terminals, A1 to A4 and B1 to B4, and three output terminals, A>B, A=B, and A<B. The comparator compares a couple of four bits inputs to output the result of the comparison from the corresponding output terminal. SN7485 by TI, for example, may be used. D1, D2 and D3 are quadrupls D-type flip-flops in which an input signal is inputted at the fall time of a timing signal and the contents inputted is outputted from the output terminals. SN74175 by TI, for example, may be used for the flip-flop. M1 is representative of a 256(32 × 8) bits programmable read only memory which has addresses each consisting of 5 bits and output signals each consisting of 8 bits are outputted from the corresponding addresses. One of the memories commercially available is IM5600 manufactured by INTERSIL Co. S1 and S2 are 4-bit binary full adders for adding two groups of 4-bit binaries, with input and output carries. SN7483 manufactured by TI is commercially available and suitable for the full adder.

The explanation to follow will be made with an assumption that the amount of movement at acceleration is equal to that required for deceleration, for easy of explanation. In FIG. 4(*a*), the portion comprising A1, B1, B2, D1 and D2, AND gates (1) and (2), and an OR gate (13) corresponds to the stop permissible position arithmetic unit (13*c*) shown in FIG. 1. As described above, since the amount of movement at acceleration = that at the deceleration, the stop permissible position may be calculated at any time by doubling the amount of movement at acceleration. PP designates a pulse signal indicating the amount of movement fed from the pulse generator (9) which is applied directly to the OR gate (13) and the monostable multivibrator A1 which produces a pulse with a fixed width at the fall time of the input pulse and the generated pulse is fed to the OR gate (13). The time delay of the monostable multivibrator A1 enables the OR gate (13) to produce two pulses by one pulse of PP. Signals ① and ② are fed from a control circuit (not shown) and include the information of the movement directions; the signal ① indicates the up-direction and the signal ② the down direction. ($\overline{STOP}$) shows a stop decision signal to be described later.

When the elevator car starts to travel, the AND gate (1) or (2) is enabled in accordance with the travelling direction. The output of the OR gate (13) passes through the AND gates (1) or (2) to reach the count-up terminal or the count-down terminal of the binary counter B1. This condition continues until the stop decision signal ($\overline{STOP}$) disables the AND gate (1) or (2). The binary counters B1 and B2 constitute a 8-bit binary counter in which the carry of the binary counter B1 is connected to the up-input of the binary counter B2 while the borrow of the counter B1 is connected to the down-input of the counter B2. The contents of the counter comprising the binary counters B1 and B2 is increased or decreased by the pulse signal PP to indicate the stop permissible position. The input terminals A, B, C, and D of the binary counters B1 and B2 are input terminals for receiving the preset inputs. Throught this connection, the position of the car (1) at the start is fed to the binary counters B1 and B2. A loading signal LOAD (1) is fed from the control circuit (not shown) immediately before it starts. The input signals to the input terminals A to D of the binary counters B1 and B2 are all fed from the floor position memory M1 to be described later. The outputs $Q_A$ to $Q_D$ of the binary counters B1 and B2 are fed to the flip-flops D1 and D2 and timing signals to the flip-flops D1 and D2 are repeatedly generated at proper timing from the control circuit (not shown). The timing signal designated by T permits these outputs to go into the flip-flops D1 and D2. As shown, the output $Q_A$ of the binary counter B1 is fed to the input 1D of the flip-flop D1 and the output $Q_D$ to the 4D. The $Q_A$ of the B2 is coupled with the 1D of the D2 and the $Q_D$ with the 4D. In this way, the outputs of the binary counters B1 and B2 are held in the flip-flops D1 and D2 through the timing signal T to ensure the signal procession at the comparison.

Figure 1:
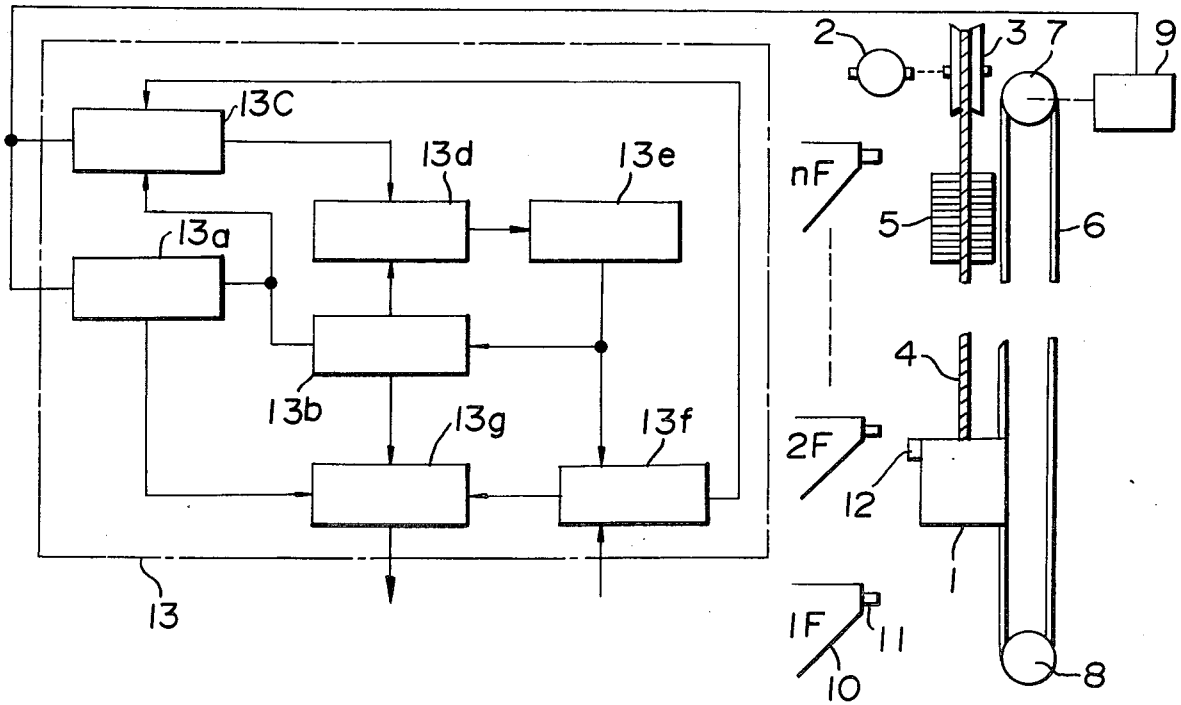
FIG. 1 illustrates, by way of block and schematic diagram, an elevator control system using an electric type floor selector.
Figure 2:
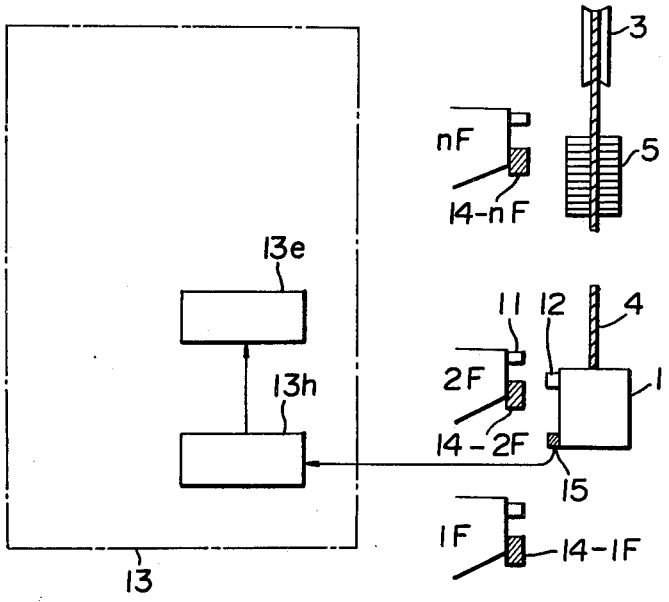
FIG. 2 shows, by way of block and schematic diagram, the major part of FIG. 1.

The portion comprised of the binary counters B3 and B4, and AND gates (3) and (4) corresponds to the car position arithmetic unit (13*a*) in FIG. 1. The operation of this circuit is the same as of the stop permissible position arithmetic unit (13*c*), except of the monostable multivibrator A1 and the OR gate (13). In the other words, the doubled movement quantity is used for the calculation in the stop permissible position arithmetic unit (13*c*) while the movement quantity not doubled is used for the same in the car position arithmetic unit (13*a*). As previously described, just before the start, the stop position of the car (1) is fed to the parallel inputs A, B, C and D of the binary counters B3 and B4. In accordance with the movement direction, the contents of the binary counters B1 and B2 are increased or decreased each reception of the pulse signal PP. In other words, the contents of the binary counters always indicates the position of the car (1) in the hoistway.

The portion comprised of the read only memory M1 corresponds to the floor position memory (13*b*) in FIG. 1. In this memory, the outputs of the memory corresponding to addresse inputs A1 to A5 are previously stored. The addresses A1 to A5 correspond to the floors. The outputs of the memory when it is addressed indicate the distances from the bottom of the hoistway, respectively. More precisely, if the car (1) now stops at the 5th floor, the address 5 is converted into a binary code and then is applied to the memory M1. At this time, the memory M1 produces an output indicating the distance of the 5th floor from the bottom of the hoistway and provides the position of the car when it starts from the 5th floor to the binary counters B1 to B4 and like.

The portion comprised of the full adders S1 and S2, exclusive OR gates 20 to 35 correspond to the remaining distance arithmetic unit (13*g*) in FIG. 1. The remaining distance arithmetic unit (13*g*) executes a binary subtraction between the output of the read only memory M1 and the outputs of the binary counters B1 and B2. In more particular, when the car (1) goes up, the outputs of the binary counters B1 and B2 are subtracted from the output of the memory M1. When the car (1) goes down, the output of the M1 is subtracted from the outputs of the counters B1 and B2. When the stop is decided, calculation is made of the remaining distance that the car (1) must travel until it will stop. Thus, calculated remaining distance is applied as distance information to the deceleration pattern generator (not shown). Generally, in the binary subtraction, the complementary of 2 of divisor and dividend are binary-added and 1 is added to the result of it. Thus, the binary subtraction is realized by using exclusive OR gates for obtaining the complementary of 2 and binary adders.

When the car (1) is travelling in the up direction, the directional signal ① is logical "1" and applied to exclusive OR gates (20), (22), (24), (26), (28), (30), (32) and (34). At this time, the output $Q_A$ of the binary counter B3 is applied to the exclusive OR gate (20), the $Q_B$ to the gate (22), the $Q_C$ to the gate (24), the $Q_D$ to the gate (26), and the output $Q_A$ of the binary counter B4 is applied to the exclusive OR gate (28), the $Q_B$ to the gate (30), the $Q_C$ to the gate (32), and the $Q_D$ to the gate (34). Therefore, the inverse output of the output $Q_A$ of the binary counter B3 appears at the output of the exclusive OR gate (20). The inverse output of the $Q_B$ of the gate (22) appears at the output of the gate (22). This is correspondingly applied to the outputs of other gates (24), (26), (28), (30), (32) and (34). That is, the complementary of the outputs of the binary counters B3 and B4 are obtained at the outputs of the exclusive OR gates. Under this condition, the directional signal ② is logical "0" and therefore the outputs D1 to D8 of the memory M1 coupled with the exclusive OR gates (21), (23), (25), (27), (29), (31), (33) and (35) are not reversed. The output D1 of the memory M1 appears at the output of the gate (21) and the output D2 appears at the output of the gate (23). Likewise, the outputs D3 to D8 are produced at the outputs of the gates (23), (25), (27), (29), (31), (33) and (35), respectively. As shown, the exclusive OR gates (20), (22), (24), and (26) are coupled with input terminals A1, A2, A3 and A4 of the full adder S2. The outputs of the exclusive OR gates (21), (23), (25), and (27) are coupled with the inputs B1, B2, B3 and B4 of the full adder S1. The carry input C1 of the full adder S1 is connected to the power source Vcc for giving logical "1". The carry output C0 of the same is connected to the carry input C1 of the adder S2. Similar circuit connection is applied to the full adder S2 except that the carrys input C1 is fed from the carry output C0 of the adder S1. In this way, when the car travels up, the remaining distance is calculated by subtracting the outputs of the binary counters B3 and B4 from the output of the memory M1.

Reference symbols C1 and C2 correspond to the comparator (13*d*) shown in FIG. 1. The C1 and C2 cooperate to constitute an 8-bit magnitude comparator. As shown, the outputs 1Q to 4Q of the flip-flops D1 and D2, i.e. the outputs of the stop permissible position arithmetic unit, are applied to the input terminals A1 to A4 of the comparators C1 and C2. The outputs D1 to D8 of the memory M1 are applied to the input terminals B1 to B4 of the comparator. The contents of the A1 to A4 and of the B1 to B4 are binary-compared and if the former is larger than the latter, the comparator produces an output of $A>B$; if they are equal to each other, it produces $A = B$; if the former is less than the latter, it produces $A<B$.

The portion comprised of a counter B5, AND gates 5, 6, 7 and 8, and OR gates 12 and 13 corresponds to the stop permissible floor indicator (13*e*) shown in FIG. 1. Signals designated by ① and ② are the directional signals. $(A>B)$ and $(A<B)$ are the outputs $(A>B)$ and $(A<B)$ of the comparator C2. A signal T2 is generated to increase or decrease by 1 the contents of the counter B5 after the loading signal LOAD 1 is fed in the control circuit (not shown). The explanation will be given of the case of the up-directional travelling of the car (1). In this case, an AND gate (7) is enabled to permit the signal T2 to go through an OR gate (12) to the up-input terminal of the counter B5, resulting in the increase of 1 of the counter B5 contents. The outputs $Q_A$, $Q_B$, $Q_C$ and $Q_D$ of the counter B5 are applied to the addresses A1 to A4 of the memory M1 in the forms of signals $(Q_A)$, $(Q_B)$, $(Q_C)$ and $(Q_D)$. The contents of the counter B5 increases by one at the start. That is, at this time, the output of the memory M1 corresponding to the floor and the outputs of the binary counters B1 and B2 are compared, resulting in production of the output of $A<B$. With travelling of the car (1), at an instant that the output of the memory M1 is smaller than the outputs of the binary counter B1 and B2, the output of $A>B$ is fed from the comparator C2 to the AND gate (5). So far as the stop is not decided, the signal of $(A>B)$ is applied through the OR gate (12) to the up-input of the counter B5 so that the contents of the counter B5 is increased by 1. The increase of 1 in the contents of the counter B5 makes the output of the memory M1 change. As a result of this, the comparators C1 and C2 produce an output of $A<B$. This will be repeated until the stop decision signal STOP is generated. This means that the car (1) starts to travel and the counter B5 indicates the next floor at which the car is to be stopped. In the case of the down travelling of the car, the signal is applied to the down-input of the counter B5 through AND gates (6)

and (8), and OR gate (13). The signal A<B is used for the output of the comparator C2. The inputs A, B, C and D of the binary counter B5 are provided so as to set the specific floor in the counter B5 when the car stops at the specific floor. The timing of loading it into the counter B5 is such that it is loaded into the counter B5 in response to the signal of (15*a*) from the detector of the car (1) when the car (1) levels with the specific floor. In the figure, the 1st floor is assigned for the specific floor, and only the input A is connected with the power source Vcc for giving the logical "1" and others B, C and D are grounded for giving logical "0".

The portion including a comparator C3, NAND gates 14, 15 16 and 17, and a call hold D3 correspond to the stop decision arithmetic unit (13*f*) shown in FIG. 1. The outputs A1 to A4 of the comparator C3 are connected to the output of the counter B5 and the inputs B1 to B4 are connected with the outputs 1Q to 4Q of the call hold circuit D3. A binary call fed from a call circuit (not shown) is loaded into the call hold circuit D3 in response to a timing signal T3 and held in it. The timing signal T3 is generated from the call circuit. When both the inputs A1 to A4 and B1 to B4 are equal in the comparator C3, i.e. a call is generated from the stop permissible floor, the comparator produces the signal A=B. Under this condition, when the comparator C2 produces the signal A=B, the output of a NAND gate 16 becomes logical "0". As a result, the flip-flop circuit comprised of NAND gates (14) and (15) is in the set state and the STOP signal is logical "0" to stop the input signals to the up- and down-inputs of the binary counters B1, B2 and B5. The above-mentioned flip-flop is reset through a NAND gate 17 by the timing signal T2 fed just before the start.

The detailed circuit diagram of FIG. 1 have been described. In actuality, calculation is performed on the basis of the pulse signal representing the movement quantity resulting from the movement of the car (1). There is a possibility that some cause causes the arithmetic units to erronously operate and, as a result, the floor at which the car actually stops is different from the desired one. In such a case, it is necessary to detect the difference of the floor.

The circuit section defined by a comparator C4, a counter B6, AND gates 9, 10 and 11 substantially indicates the comparator (13*j*) and the floor indicator (13*j*).

A signal (15*b*) is a pulse signal generated each time the car (1) levels with the floor, as mentioned above. The signal is fed to the up-input of the counter B6 by way of the AND gate (9) when the car travels in the up direction, while it is fed to the down-input of the counter B6 by way of the AND gate (10) in the travelling in the down direction. A signal (15*a*) is the one obtained when the car (1) levels with the specific floor, and is used as a loading signal for loading a signal into the counter B6. In the figure, the loading is made in a condition that only the A input of the counter B6 is logical "1" while the others B, C and D are logical "0". This means that the specific floor is assigned for the 1st floor. When the car starts to travel from the 1st floor in the up-direction, the contents of the counter B6 is increased by one each time the car levels with the floor and, in a normal operation, the counter B6 indicates the position of the car (1) travelling up in terms of the floor. When the car (1) travels to stop, the comparator C4 compares the contents of the counter B6 with that of the counter B5. At this time, if the contents of them are equal, the elevator system operates with an assumption that the calculations of the counters B5 and B6 are correct. If they are not equal, it is decided that some cause causes the counters to erroneously operate. With such a decision, the car (1) is moved to the specific floor and a command to correct the erroneous operation is given to the control circuit (not shown). The control of an AND gate (11) with the output of A=B of the comparator C4 as a command to move the car to the specific floor and to be fed via the AND gate 11, is made by a signal FN for indicating being in stop which is fed from the control circuit (not shown). At the time that the signal FN enables the AND gate (11), if the output of the comparator is A=B and logical "1", the signal of "1" is fed to the control circuit (not shown), thereby permitting the operation to continue. At this time, if the output is logical "0", i.e. A≠B, the signal is the one for indicating the movement of the car to the specific floor.

As described above, in the present invention, the output of the floor indicator representing the floor at which the car actually stops and the output of the stop permissible floor indicator representing the electrically calculated stop floor when the car stops, are compared. In the comparison, when these outputs are different, the car is moved to the specific floor and, at the specific floor, the floor indicator and the stop permissible floor indicator are set to the specific floor. With such an arrangement, even if slip takes place between the speed regulator rope and the speed regulator sheave and therefore the floor at which the car actually stops is different from the floor indicated by the stop permissible floor indicator, the correction of it may be quickly made, thus ensuring the normal elevator service.

What is claimed is:

1. An elevator control system using an electric type floor selector comprises: a unit provided at at least one of the specific floors in the hoistway and indicating the specific floor; units provided at the other floors than said specific floors and for indicating merely the floor; a detecting means provided at a car in which presence of both units is detected and, when said detector levels with said respective units, said detector generates a signal corresponding to it; a floor indicator for indicating the floor at which the car actually stops by using the detected signal; and a stop permissible floor indicator for indicating the electrically calculated stop floor when the car stops, in which comparison is made of the output of said floor indicator with the output of said stop permissible floor indicator; when these outputs are different, the car is moved to the specific floor and, when the car stops at the specific floor, said floor indicator and said stop permissible floor indicator are set to said specific floor.

2. An elevator control system using an electric type floor selector according to claim 1, in which a plurality of specific floors are used; a calculation is made of the distances between the floor indicated by said stop permissible indicator or the floor indicated by said floor indicator and the specific floors; and the car is moved toward the specific floor with the shortest distance.

* * * * *